United States Patent [19]

Wenmaekers

[11] Patent Number: 5,060,700

[45] Date of Patent: Oct. 29, 1991

[54] DISPENSER FOR A VISCOUS SUBSTANCE

[76] Inventor: Paul Wenmaekers, 22 bis avenue de Suffren, 75015 Paris, France

[21] Appl. No.: 490,423

[22] Filed: Mar. 8, 1990

[30] Foreign Application Priority Data

Mar. 13, 1989 [FR] France ..... 89 03236

[51] Int. Cl.[5] ..... B65D 83/00; B65D 35/28

[52] U.S. Cl. ..... 141/20; 141/3; 141/114; 222/95; 222/214; 222/97; 222/105; 222/386.5

[58] Field of Search ..... 141/3, 18, 20, 114; 222/94, 95, 96, 97, 103, 105, 106, 107, 386.5, 214

[56] References Cited

U.S. PATENT DOCUMENTS

| | | | |
|---|---|---|---|
| 2,053,697 | 9/1936 | Cassanos et al. | 222/103 |
| 2,533,839 | 12/1950 | Robinson | 222/103 |
| 2,591,296 | 4/1952 | Rogers | 222/103 X |
| 2,600,631 | 6/1952 | Freedman | 222/103 |
| 2,613,853 | 10/1952 | Halvorsen | 222/103 |
| 2,776,077 | 1/1957 | Freedman | 222/103 |
| 3,084,722 | 4/1963 | Klingerman | 222/103 X |
| 3,335,913 | 8/1967 | Bouet | 222/95 |
| 3,791,557 | 2/1974 | Venus, Jr. | 222/105 |
| 4,136,802 | 1/1979 | Mascia et al | 222/95 |
| 4,147,278 | 4/1979 | Uhlig | 222/94 |
| 4,228,925 | 10/1980 | Mendelovich | 222/103 |
| 4,440,317 | 4/1984 | Clark et al. | 222/103 |
| 4,981,238 | 1/1991 | Wenmaekers | 222/103 |

FOREIGN PATENT DOCUMENTS

| | | | |
|---|---|---|---|
| 0300886 | 1/1989 | European Pat. Off. . | |
| 89921 | 4/1966 | France . | |
| 0009187 | 1/1989 | Japan | 222/103 |
| WO88/00563 | 1/1988 | PCT Int'l Appl. . | |

*Primary Examiner*—Ernest G. Cusick

*Attorney, Agent, or Firm*—Nixon & Vanderhye

[57] ABSTRACT

The invention relates to a receptacle for dispensing a viscous substance. A receptacle body contains resilient structure bearing against the inside wall of the receptacle body. This structure comprise first and second spring-forming resilient blades with a reservoir made of flexible material placed between the inside faces thereof. An external return spring acts on the outside faces of the springs. The invention is applicable to making a receptacle for dispensing a viscous substance without using a propellant gas.

3 Claims, 2 Drawing Sheets

DISPENSER FOR A VISCOUS SUBSTANCE

The present invention relates to an improvement to the viscous substance dispensing receptacle as described and shown in French patent application Number 87 10053 filed July 16, 1987 and published Jan. 20, 1989 under the Number 2618127, corresponding to U.S. patent application Ser. No. 219,142 filed on 07/15/1988.

BACKGROUND OF THE INVENTION

As shown in accompanying FIG. 1, the receptacle described in this prior document comprises a receptacle body 1 provided with a reservoir 2 containing the substance to be dispensed and a dispenser head 3 suitable for being controlled to open or close, the reservoir 2 being made of a flexible material and the receptacle further including pressure means 20, 23 for exerting pressure continuously on the reservoir 2 in the presence of the substance, thereby enabling the substance to be dispensed merely by causing the dispenser head 2 to open.

The above-described receptacle operates satisfactorily.

However, during development and improvement testing on the above-mentioned receptacle, it has been observed that it is advantageous to provide pressure means that exert their effect differently as a function of the dispensing and restitution power of the substance to be dispensed.

SUMMARY OF THE INVENTION

The improvement of the present invention to the receptacle for dispensing a viscous substance according to French patent application Number 87 10053 filed July 16, 1987 is remarkable in that the resilient means bearing against the inside wall of the body of the receptacle comprise first and second spring-forming resilient blades between whose inside faces the reservoir made of flexible material is placed, together with external return means acting on the outside faces of the springs.

As a function of the force of the external return means, the receptacle of the invention can be used for dispensing creamy substances, i.e. highly viscous substances packed at a pressure of 800 g/cm$^2$, or else substances which are more fluid, such as emulsions.

BRIEF DESCRIPTION OF THE DRAWINGS

An embodiment of the invention is described by way of example with reference to the accompanying drawings, in which.

DETAILED DESCRIPTION

Figure 1:
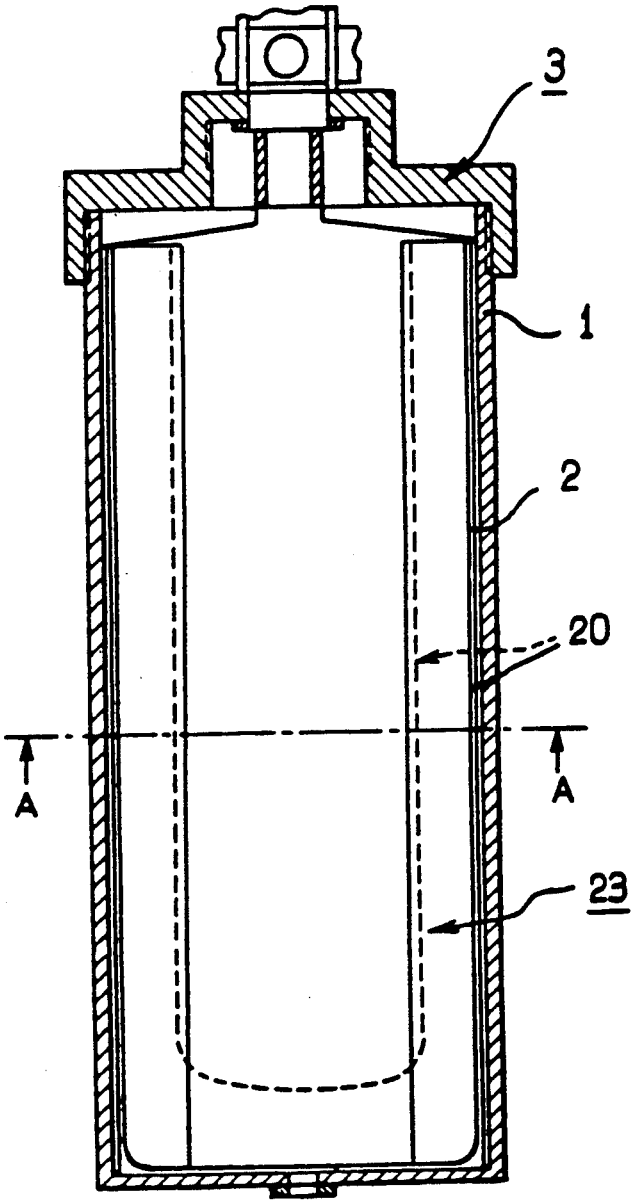
FIG. 1 (PRIOR ART)
FIG. 1 is a diagrammatic longitudinal section through a prior art dispensing receptacle as described in French patent application Number 87 10053.

As shown in accompanying FIG. 1, the receptacle for dispensing a viscous substance to which the present invention applies comprises a receptacle body 1 provided with a reservoir 2 containing the viscous substance to be dispensed. The receptacle for dispensing a viscous substance also includes a dispenser head 3 capable of being opened or closed in order to dispense the above-mentioned substance or else to cause it to be stored in the receptacle.

The reservoir referenced 2 is made of flexible material and means referenced 20, 23 and referred to as "pressure" means serve to exert pressure continuously on the reservoir 2 when it contains the substance. The above-mentioned pressure means associated with the reservoir of flexible material serve to cause the viscous substance to be dispensed merely by opening the dispenser head.

The reservoir 2 is advantageously made of a resilient flexible material constituting the wall(s) of the reservoir. While the viscous substance to be dispensed is being inserted into the reservoir, these walls are put under mechanical tension and, in this case, the pressure means 20 are constituted in non-limiting manner by the resilient tension in the walls.

The receptacle for dispensing a viscous substance in accordance with the invention is now described with reference to FIGS. 2*a* and 2*b*.

Figure 2A:
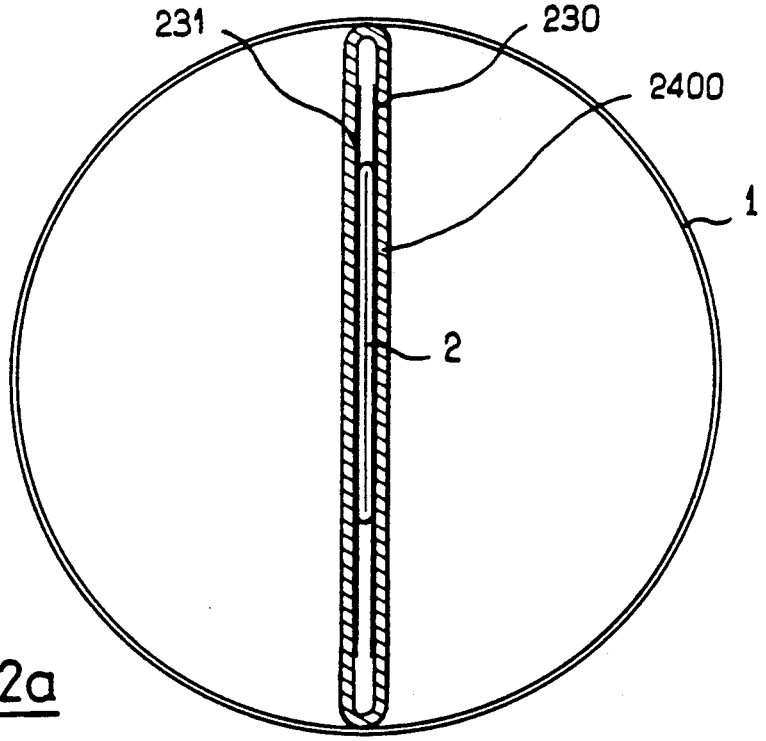
FIG. 2*a* is a cross-section view of an embodiment of the invention showing the reservoir made of resilient material when empty.

In FIG. 2*a*, which is a cross-section view through the dispenser on section plane AA of FIG. 1, the resilient means bearing against the inside wall of the receptacle body 1 comprise first and second spring-forming resilient blades 230 and 231 with the reservoir 2 made of flexible material being placed between the inside faces thereof. In addition, means 2400 acting as external return means act on the outside faces of the springs.

In FIG. 2*a*, the first and second resilient blades 230 and 231 are shown surrounding the reservoir 2 made of flexible material when the reservoir is completely empty.

Figure 2B:
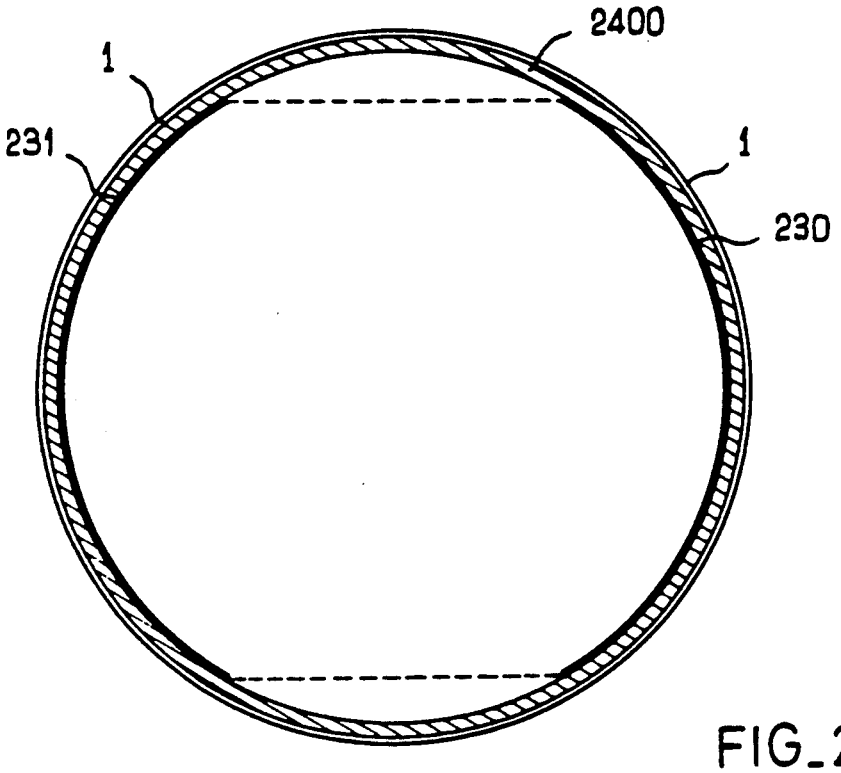
FIG. 2*b* shows the same embodiment when the reservoir made of resilient material is partially filled.

In the embodiment shown in FIGS. 2*a* and 2*b*, the external return means are advantageously constituted by a resilient sheath 2400, which is applied to the outside faces of the resilient blades 230 and 231.

According to an advantageous characteristic of the embodiment of FIGS. 2*a* and 2*b*, the resilient sheath 2400 is stretched over the resilient blade 230 and 231 while the reservoir 2 made of resilient material is empty, so that the two resilient blades 230 and 231 are separated by a minimum gap. In order to assemble the assembly constituted by the reservoir 2 made of resilient material contained in the space delimited by the first and second resilient blades 230 and 231 and by the sheath 2400, the sheath is deformed transversely so as to have an elongation dimension greater than the size of the blades 230 and 231, with the subassembly constituted by the resilient blades 230 and 231 and the reservoir 2 made of resilient material then being inserted in the expanded sheath. After the above-mentioned subassembly has been appropriately disposed inside the sheath, the sheath is released and sits directly over the resilient blade 230 and 231, against the outside walls thereof.

Naturally, the resilient sheath 2400 may be constituted by a cylindrical rubber sleeve whose diameter, when undeformed, is smaller than the diameter of the receptacle body 1. Preferably, the rubber sleeve is selected to be of average quality, e.g. a sleeve of synthetic rubber, since, naturally, the viscous substance to be dispensed does not come into direct contact therewith.

It may also be observed that the embodiment shown in FIGS. 2*a* and 2*b* has the advantage of isolating the resilient steel blades 230 and 231 from making contact with the receptacle body 1, which contact should be avoided in particular when the receptacle body 1 is made of aluminum, so as to avoid electropositive interactions between the aluminum and the steel.

The embodiment shown in FIGS. 2*a* and 2*b* is thus very cheap insofar as it can be used with resilient blades 230 and 231 which are thin, thereby reducing manufacturing costs. The ability to restitute the viscous substance is thus linked not only to the resilience of the springs and to their mechanical quality, but also to the elasticity of the sleeve 2400. Naturally, the ability to restitute the viscous substance may be adjusted by selecting the thickness of the resilient blades 230, 231, and the elasticity and the tension of the sheath 2400. The embodiment shown in FIGS. 2*a* and 2*b* is particularly suited for dispensing emulsions of the viscous substance type presented in the form of a lotion, such as a cleansing lotion or even a substance which is medical in nature, such as Biafine, as sold in France by Laboratoires MEDIX and is representatives.

A particularly effective receptacle has thus been described for dispensing a viscous substance, given that external action of the spring or of the resilient blades makes it possible to adjust the dispensing power applied to the viscous substance under consideration as a function of the application under consideration.

I claim:

1. A receptacle for dispensing a viscous substance, the receptacle being of the type comprising a receptacle body provided with a reservoir containing the substance to be dispensed, and a dispenser head suitable for being caused to open or to close, the reservoir being made of a flexible material and the receptacle further including pressure means for exerting pressure permanently on the reservoir when containing the substance, thereby enabling the substance to be dispensed merely by causing the dispenser head to open, wherein said pressure means bearing against an inside wall of the receptacle body comprise:

first and second spring-forming resilient flat blades with said reservoir made of flexible material being placed between inside faces thereof; and a resilient sheath receiving the resilient blades and said reservoir between said blades, said resilient sheath being extended over said resilient blades when the reservoir made of resilient material is empty, the two resilient blades then being at a minimum distance apart, so that said resilient sheath applies a dispensing force on outside faces of said blades.

2. A receptacle according to claim 1, wherein said resilient sheath is constituted by a cylindrical rubber sleeve whose diameter, in the absence of deformation, is less than the diameter of the receptacle body.

3. The receptacle according to claim 1 wherein said resilient blades have edges and said resilient sheath comprises means for forcing adjacent edges of said two resilient blades towards each other and for permitting separation of edges of said two resilient blades when said reservoir is at least partially full.

* * * * *